United States Patent [19]

Henderson et al.

[11] Patent Number: 4,581,500

[45] Date of Patent: Apr. 8, 1986

[54] ROTARY SWITCH

[75] Inventors: Clarence M. Henderson; James T. Nickles, both of Scottsdale; Robert L. Wannemacher, Jr., Mesa, all of Ariz.

[73] Assignee: Motorola, Inc., Schaumburg, Ill.

[21] Appl. No.: 680,103

[22] Filed: Dec. 10, 1984

[51] Int. Cl.[4] ..... H01H 19/00; H01H 21/00

[52] U.S. Cl. ..... 200/11 DA; 200/11 A; 200/292; 200/333

[58] Field of Search ..... 200/1 R, 5 R, 8 R, 8 A, 200/11 R, 11 A, 11 D, 11 DA, 11 G, 11 U, 11 TW, 14, 292, 333

[56] References Cited

U.S. PATENT DOCUMENTS

| | | | |
|---|---|---|---|
| 2,870,274 | 1/1950 | Thias | 200/11 R |
| 2,988,606 | 6/1961 | Allison | 200/11 A |
| 3,005,881 | 10/1961 | Ellsworth | 200/11 TW |
| 3,132,216 | 5/1964 | Adams | 200/11 TW |
| 3,284,583 | 11/1966 | Buzzi | 200/11 TW |
| 3,772,485 | 11/1973 | Workings | 200/11 TW |
| 3,794,784 | 2/1974 | Snider | 200/11 A |
| 4,052,573 | 10/1977 | Kojima | 200/11 A X |
| 4,158,114 | 6/1979 | Butler et al. | 200/1 R |
| 4,196,324 | 4/1980 | Kojima et al. | 200/11 DA |

*Primary Examiner*—J. R. Scott

*Attorney, Agent, or Firm*—Raymond J. Warren

[57] ABSTRACT

An apparatus and method is disclosed for providing a rotor switch. The rotor switch consists of a rotor device positioned between a pair of printed circuit boards. One printed circuit board having conductive pads, coupled to the output of the switch, and the other board having a conductive strip, coupled to the input of the switch. A conductive spring, or similar conductor, is disposed through the rotor to couple one of the conductive pads to the conductive strip. A housing having a retainer that fits into exterior notches located in the printed circuit boards and the rotor acts to secure the rotor in place when rotational forces are exerted on the switch.

9 Claims, 6 Drawing Figures

ROTARY SWITCH

BACKGROUND OF THE INVENTION

1. Field of the Invention

This invention relates, in general, to switches and, more particularly, to compact rotary switches capable of providing variable settings and of sustaining high "G" forces and rapid decompression.

2. Description of the Prior Art

Many rotary switches are known in the prior art. However, due to their standard configuration these switches are incapable of sustaining the acceleration and rotational forces about their axis that accompany the firing of these devices when incorporated in projectiles. Further, the prior art is incapable of having several switches stacked without a substantial increase in size due to the center posts that are attached to each switch. In addition, the prior art switches use metal rotaries that are not applicable to use in compact compression environments.

SUMMARY OF THE INVENTION

Accordingly, it is an object of the present invention to provide a new and improved rotary switch and method of operation.

A further object of the present invention to provide a rotary switch and method of operation that will not be affected by high "G", acceleration, forces.

Still another object of the present invention is to provide a rotary switch and method of operation thereof that will not be affected by high rotational forces, RPMs.

Yet another object of the present invention is to provide a rotary switch and method of operation that will not be affected by rapid decompression.

Yet another object of the present invention is to provide a rotary switch that is more compact.

Yet another object of the present invention is to provide a rotary switch that utilizes printed circuit boards.

The above and other objects and advantages of the present invention are provided by a rotary switch and method of operation that utilizes at least two printed circuit boards having input and output conductors on opposite sides of each board, and a rotary nonconductive material therebetween containing a connector to couple the bottom of one board to the top of another.

A particular embodiment of the present invention consists of a switch device having an input and an output. The switch device comprises a first conducting means for connecting the input to the output of the switch device. The first conducting means has a notch and a plurality of conducting pads, at least one of which is coupled to either the input or output of the switch device. The switch device further comprises a second conducting means for connecting the input to the output of the switch device. The second conducting means has a notch and a conductive strip that is coupled to the remaining input or output of the switch device. In addition, the switch device comprises an adjusting means for adjusting the setting of the switch device. The adjusting means has a notch and an opening extending through the adjusting means. Finally, the switch devices comprises a connecting means for connecting one of the plurality of conductive pads to the conductive strip. The connecting means is disposed in the opening of the adjusting means.

DETAILED DESCRIPTION OF THE DRAWINGS

Figure 1:
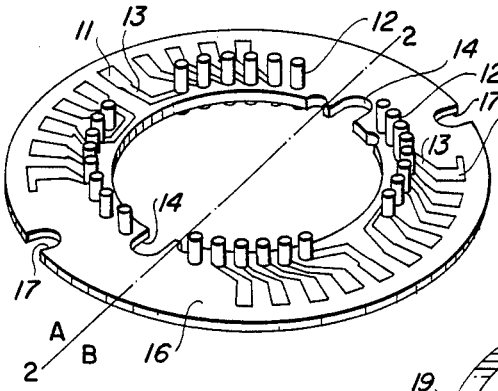
FIG. 1 is a perspective view illustrating one side of a printed circuit board embodying the present invention.

Referring to the diagram of FIG. 1 a perspective view of a side 16 of a printed circuit board, generally designated 10, embodying the present invention is illustrated. In this embodiment printed circuit board 10 is a disk shaped piece of electrically nonconductive material with a circumferential edge and a coaxial central opening therethrough defining an inner edge. Printed circuit board 10 is illustrated having two separate electrical channels, or portions, A and B. This particular design is utilized for redundancy purposes (i.e. having two channels set the same). It should be noted that, if desired, only one channel need be provided and this channel could cover the entire surface of baord 10. In addition, more than two channels may be used for redundancy purposes or for independent settings.

Board 10 has conductive pads 11 spaced about its circumference. Each conductive pad 11 is coupled to a post 12 by a conductor 13. These have been removed for convenience in illustrating board 10. As is illustrated here several of posts 12 are not coupled to pads 11. These are coupled to conductive strips on the bottom of boards 10 and will be discussed in conjunction with FIG. 2 below.

Notches 14 are provided in the inner edge of board 10 to allow a securing bolt to be placed in the switch which will be discussed below in conjunction with FIG. 6. Notches 17 are provided in the outer edge of board 10 to prevent board 10 from rotating due to rotational forces exerted on the switch device. This will also be illustrated further in conjunction with the discussion of FIG. 6.

Figure 2:
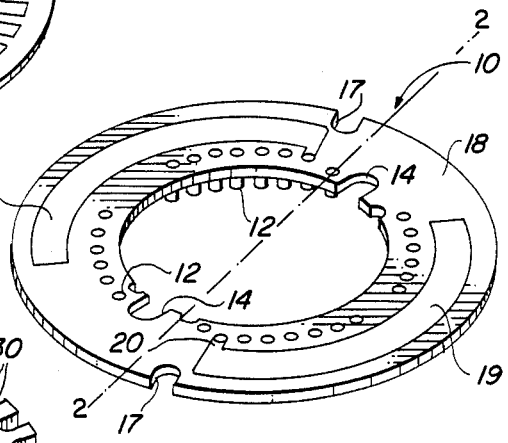
FIG. 2 is a perspective view of FIG. 1 rotated 180° about line 2—2 illustrating a second side of the printed circuit board embodying the present invention.

Referring now to FIG. 2, a perspective view of FIG. 1 rotated 180° about line 2—2 is illustrated showing a second side 18 of board 10. An arcuate conductive strip 19 is disposed partially about the circumference of side 18 in portion A and is coupled to the base of a post 12 by a conductor 20. Conductor 20 is coupled, for example, to the base of one of posts 12 that was not coupled to a conductive pad 11 in FIG. 1. A second arcuate conductive strip 19 is disposed on portion B. It should be noted that should one channel be used, a single conductive strip could be set about the circumference of side 18.

Figure 3:
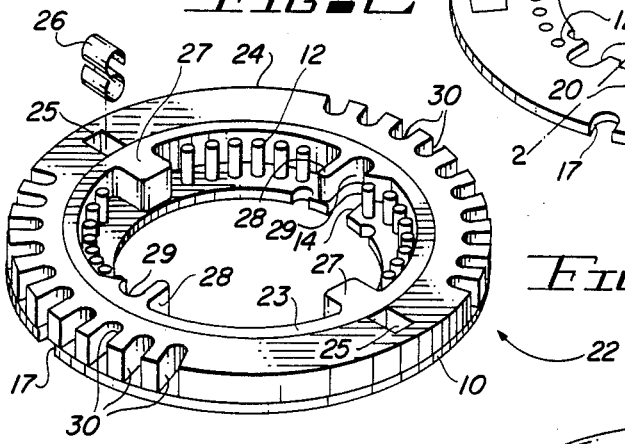
FIG. 3 is a perspective view of a rotary switch device embodying the present invention.

Referring now to FIG. 3, a perspective view of a rotary switch device, generally designated 22, is illustrated. Rotary switch 22 has a printed circuit board 10 of the type shown in FIGS. 1 and 2 as a base with a ring shaped nonconductive bushing 23, having a central opening therethrough, set on board 10. Bushing 23 is disposed coaxially within the opening of board 10 such that pins 12 are disposed within the central opening of bushing 23. Nodes 27 and 28 extend radially inward from the inner circumference of bushing 23 and are used to keep bushing 23 from rotating. Nodes 27 and 28 are designed to fit between pins 12 to hold bushing 23 in place. Nodes 28 have nothces 29, aligned with notches 14 of board 10, and are provided for a fastener bolt which will be illustrated below in conjunction with FIG.6.

A nonconductive rotor 24 with central opening disposed therethrough is placed about the exterior of bushing 23 in a fashion such that rotor 24 will rotate freely about bushing 23. Notches 25 are located on the interior circumference of rotor 24. There will be one notch 25 for each separate channel of switch 22. A conductive "S" spring 26 is placed in notch 25 to provide contact from pads 11 (FIG. 1) of board 10 to conductive strip 19 (FIG. 2) of a second board 10, not illustrated, which would be placed on switch 22 sandwiching rotor 24 and bushing 23 between the two boards.

Rotor 24 has a series of notches 30 formed about its exterior circumference. Notches 30 are designed such that at any rotary setting available one of notches 30 will align with notch 17 of board 10. Notches 30 are provided to prevent switch 22 from rotating due to rotational force. This will be discussed in more detail in conjunction with FIG. 6 below.

Figure 4:
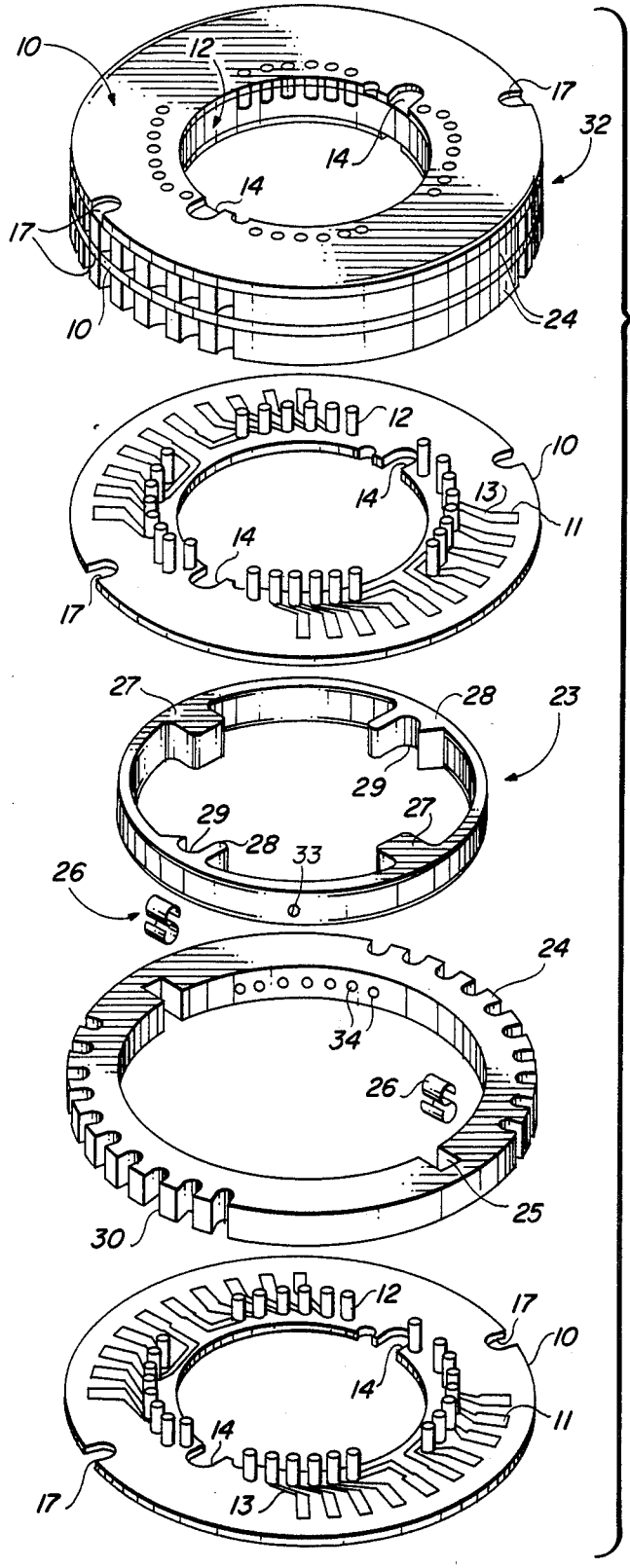
FIG. 4 is an exploded view in perspective of a rotary switch device embodying the present invention.

Referring now to FIG. 4 an exploded view in perspective of a switch device, generally designated 32, embodying the present invention is illustrated. Device 32 is illustrated embodying three separate rotaries 24 stacked together. It should be noted that device 32 may be designed having one or more rotary levels and is not limited to three. Inside each rotary is a bushing 23. Each rotor 24 is sandwiched between two printed circuit boards 10. The top printed circuit board 10 has a bottom side, as illustrated in FIG. 2, but is without a top side. The top side may be provided thereby eliminating the need for a special board. The lowest printed circuit board 10 will have a top side, as is illustrated in FIG. 1, but does not have a bottom side. A bottom side may also be provided thereby eliminating the need for a special board.

An optional detent 33 may be placed on the outer circumference of bushing 23 with corresponding indentations 34 on the inner circumference of rotor 24. This causes detent 33 to extend into indentations 34 at each separate switch position. This is often desired so that the clicking sound that accompanies the rotary action can be heard, or to know when the switch is in place. Once the separate switches are placed together the corresponding posts 12 on each board 10 are wired together by pins, or the like, extending through posts 12 from the top to the bottom of device 32.

Figure 5:
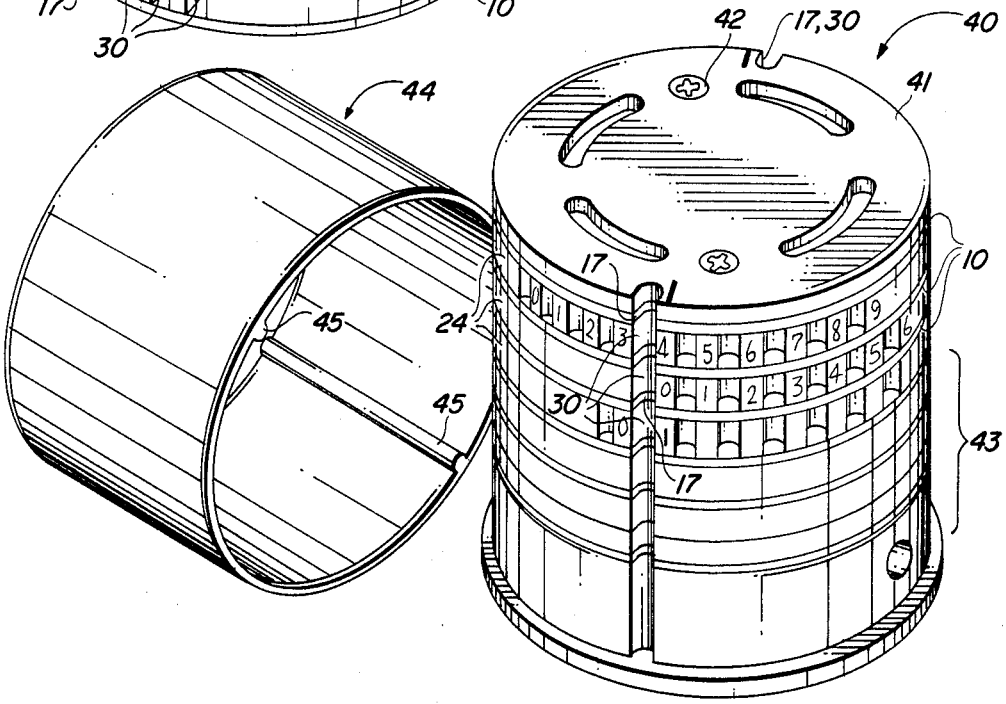
FIG. 5 is a schematic diagram of a switch embodying the present invention.

Referring now to FIG. 5 a schematic diagram of a switch embodying the present invention is illustrated. FIG. 5 illustrates a switch having three rotaries, as in FIG. 4. Each rotary has two channels, A and B, for redundancy as discussed hereinabove in conjunction with FIG. 1. Encoding lines EA1–EA10 and EB1–EB10 are coupled to pads 11 of board 10 through pins 12 (see FIG. 1). Code lines CA1–CA3 and CB1–CB3 are coupled to strips 19 of board 10 through pins 12 (see FIG. 2). As rotor 24 is turned, "S" spring 26 makes contact between strip 19 of one board 10 and pad 11 of a second board 10. This completes a circuit as is illustrated by rotary 1 of FIG. 5 where code line CA1 is coupled to encoding line EA7 for channel A and CB1 is coupled to EB7 for channel B. Code lines CA2 and CA3 are coupled to pins 12 different from that of CA1 such that three different settings may be made, one for each switch. The encoding lines EA1–EA10 and EB1–EB10, are then coupled to circuitry, such as a timer or the like. to set a device to the code set by the switch.

Figure 6:
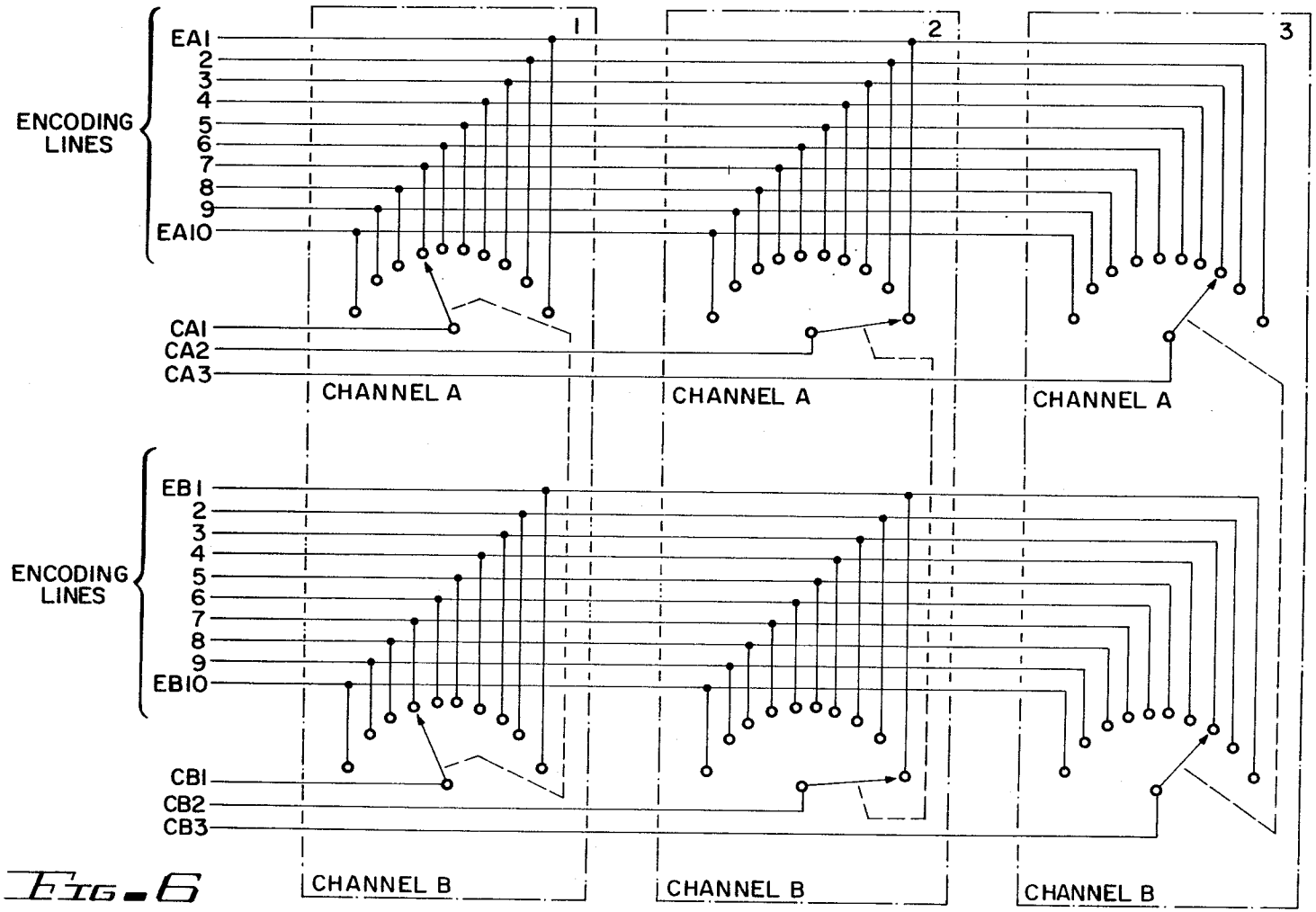
FIG. 6 is a perspective view of a rotary switch embodying the present invention.

Referring now to FIG. 6 a perspective view of a rotary switch, generally designated 40, embodying the present invention is illustrated. Switch 40 has three rotors 24 and four boards 10. The stacking of rotors 24, designed in this manner, provides a switch that will withstand higher "G" forces since when boards 10 are compressed there is support to prevent them from breaking and the contact between boards is insured from "S" springs 26 (FIG. 3). Located above rotors 24 and boards 10 is a hold down plate 41. Extending through plate 41 are screws 42. Screws 42 extend through switch 40. Screws 42 extends through notches 14 of board 10 (FIGS. 1 and 2) and through the notches in nodes 28 of bushing 23 (FIG. 3). Screws 42 prevent disks 10 and bushings 23 from rotating due to centrifugal forces.

Below boards 10 and rotors 24 is a mount 43. Mount 43 may be used to house the circuitry that is set by rotors 24 along with any additional circuitry. In the center of switch (i.e. the hollow area provided by boards 10 and rotors 24) batteries may be placed to operate the circuitry housed in mount 43.

FIG. 6 further illustrates a housing 44 having a retainer 45 attached thereto. As housing 44 is placed over switch 40 retainer 45 extends through notches 30 of rotors 24 and notch 17 of boards 10. This prevents rotors 24 from rotating when exposed to high rotational forces.

In operation the present invention is often used in environments that are subject to high acceleration and centrifugal forces. The acceleration is compensated by making the switches compact to avoid damage and secure to avoid separation. The advantage of using an "S" spring as a contact between two printed circuit boards is that when these boards are compressed together during acceleration the "S" springs will maintain contact and will flex to prevent the spring from doing damage to the printed circuit boards. Notches located along a line outside the switches provides a groove for the retaining rod located in the cover. This prevents the switches from changing settings when exposed to high rotational forces.

Thus, it is apparent that there has been provided in accordance with the invention, a device and method that fully satisfies the objects aims and advantages set forth above.

It has been shown above that the present invention provides a rotary switch and method of operation that will not be adversely effected by high rotational forces or high acceleration forces. It has been shown that the present invention further provides a switch that is compact; has variable settings; and is capable of having several switches stacked together.

While the invention has been described in conjunction with specific embodiments thereof, it is evident that many alterations, modifications, and variations will be apparent to those skilled in the art in light of the foregoing description. Accordingly, it is intended to embrace all such alterations, modifications and variations in the appended claims.

We claim:

1. A switch device having an input and an output, said switch device comprising:

first conducting means having at least one notch and a plurality of conducting pads at least one of which is coupled to one of said input and output of said switch device;

second conducting means having at least one notch and a conductive strip being coupled to the remaining one of said input and output of said switch device;

adjusting means for adjusting the settings of said switch device, said adjusting means being rotatably disposed between said first and second conducting means, said adjusting means having at least one notch and at least one opening extending therethrough;

connecting means for electrically connecting one of said plurality of conductive pads to said conductive strip, said connecting means being disposed in said at least one opening of said adjusting means, said connecting means being provided in conjunction wtih said first and second conducting means for coupling said input to said output of said switch device; and housing means for covering said first and second conducting means, said adjusting means and said connecting means, said housing means having a retainer coupled thereto such that said retainer is disposed through said at least one notch of said first and second conducting means and said adjusting means.

2. The device of claim 1 wherein said first conducting means comprises a first printed circuit board having a first side, said first side having said plurality of conducting pads mounted thereto.

3. The device of claim 2 wherein said second conducting means comprises a second printed circuit board having a second side, said second side having said conductive strip mounted thereto.

4. The device of claim 3 wherein said adjusting means comprises:

a bushing disposed between said first and second conducting means; and a rotor being rotatably disposed about said bushing between said first and second conducting means, said rotor having a hole disposed therethrough.

5. The device of claim 4 wherein said connecting means comprises a conductive spring being disposed in said at least one opening of said adjusting means.

6. A method of setting a rotor switch having an input and an output comprising the steps of:

providing a first conductive means having at least one notch and a plurality of conductive pads at least one of which is coupled to one of said input and output of said rotor switch;

providing a second conductive means having at least one notch and a conductive strip being coupled to the remaining one of said input and output of said rotor switch;

providing an adjusting means for adjusting the setting of said rotor switch, said adjusting means having at least one notch and being placed between said first and second conductive means;

providing a conductive connector disposed in said adjusting means, said conductive connector being provided in conjunction with said first and second conductive means for coupling said input to said output of said rotor switch;

adjusting said adjusting means coupling one of said plurality of said conductor pads to said conductive strip through said conductive connector; and covering said first and second conductive means, said adjusting means and said conductive connector with a housing means, said housing means having a retainer coupled thereto such that said retainer is disposed through said at least one notch of said first and second conductive means and said adjusting means.

7. A switch device having an input and an output, said switch device comprising:

a first printed circuit board having at least one notch and a plurality of conducting pads at least one of which is coupled to one of said input and output of said switch device;

a second printed circuit board having at least one notch and a conductive strip being coupled to one of said remaining input and output of said switch device;

a bushing disposed between said first and second printed circuit boards;

a rotor being rotatably disposed about said bushing between said first and second printed circuit boards, said rotor having at least one notch and at least one opening disposed therethrough; and connecting means for electrically connecting one of said plurality of conductive pads to said conductive strip, said connecting means being disposed in the opening of said rotor; and housing means for covering said bushing, rotor, connecting means, and said first and second printed circuit boards, said housing means having a retainer coupled thereto such that said retainer is disposed through said at least one notch of said first and second printed circuit boards and said rotor.

8. The device of claim 7 wherein said connecting means comprises at least one conductive spring being disposed in said at least one opening of said rotor.

9. A switch device having an input and an output, said switch device comprising:

a first printed circuit board consisting of:

a disk shaped electrically nonconductive material having side, a coaxial central opening therethrough defining an inner edge, and a circumferential edge having at least one notch disposed therein; and a plurality of conductive pads mounted on said side of said first printed circuit board at least one of which is coupled to said one of said input and output of said switch device;

a second printed circuit board consisting of:

a disk shaped electrically nonconductive material having a side, a coaxial central opening disposed therethrough defining an inner edge, and a circumferential edge having at least one notch disposed therein; and an arcuate conductive strip mounted on said side of said second printed circuit board coupled to a remaining one of said input and output of said switch device;

a first circular shaped electrically nonconductive material having an outer circumferential edge having at least one notch disposed therein, a coaxial central opening therethrough defining an inner edge, and at least one connector opening being disposed therethrough, said first circular shaped electrically nonconductive material being rotatably disposed between said first and second printed circuit boards;

a second circular shaped electrically nonconductive material having an outer circumferential edge and a coaxial central opening therethrough defining an inner edge, said second circular shaped electrically nonconductive material being disposed in the coaxial central opening of said first circular shaped electrically nonconductive material between said first and second printed circuit boards;

a conductive spring connector having a first end and a second end opposite said first end, said conductive spring connector being disposed in said at least one connector opening of said first circular shaped electrically nonconductive material, said first end of said conductive spring connector contacting one of said plurality of conductive pads of said first printed circuit board and said second end of said conductive spring connector contacting said arcuate conductive strip of said second printed circuit board; and a cylindrical shaped cover having an inner wall, a top and a retaining bar coupled to said inner wall, said cylindrical shaped cover being disposed about said first circular shaped electrically nonconductive material and said first and second printed circuit boards, said retaining rod being disposed in said at least one notch of said first circular shaped electrically nonconductive material and said first and second printed circuit boards.

* * * * *